US010340646B2

(12) United States Patent
Nguyen et al.

(10) Patent No.: US 10,340,646 B2
(45) Date of Patent: Jul. 2, 2019

(54) ELECTRICAL ADAPTER WITH INTEGRAL CONNECTOR

(71) Applicant: CORDELIA LIGHTING, INC., Rancho Dominguez, CA (US)

(72) Inventors: Huan C. Nguyen, Placentia, CA (US); Aaron O'Brien, Los Alamitos, CA (US)

(73) Assignee: Cordelia Lighting Inc., Rancho Dominguez, CA (US)

( * ) Notice: Subject to any disclaimer, the term of this patent is extended or adjusted under 35 U.S.C. 154(b) by 0 days.

(21) Appl. No.: 16/114,143

(22) Filed: Aug. 27, 2018

(65) Prior Publication Data

US 2019/0067890 A1 Feb. 28, 2019

Related U.S. Application Data

(60) Provisional application No. 62/550,551, filed on Aug. 25, 2017, provisional application No. 62/659,625, filed on Apr. 18, 2018.

(51) Int. Cl.

| | |
|---|---|
| ***H01R 4/38*** | (2006.01) |
| ***H01R 33/945*** | (2006.01) |
| ***H01R 13/627*** | (2006.01) |
| ***H01R 13/635*** | (2006.01) |
| ***H01R 13/717*** | (2006.01) |
| *H01R 13/422* | (2006.01) |
| *H01R 13/504* | (2006.01) |

(52) U.S. Cl.
CPC ..... *H01R 33/9453* (2013.01); *H01R 13/6276* (2013.01); *H01R 13/635* (2013.01); *H01R 13/7175* (2013.01); *H01R 13/422* (2013.01); *H01R 13/5045* (2013.01)

(58) Field of Classification Search
CPC ..... H01R 13/5045; H01R 13/635; H01R 13/6276; H01R 13/7175; H01R 33/9453; H01R 33/22; H01R 13/639; H01R 13/695
USPC ..... 439/257
See application file for complete search history.

(56) References Cited

U.S. PATENT DOCUMENTS

| | | | | |
|---|---|---|---|---|
| 5,456,611 | A * | 10/1995 | Henry | H01R 13/6395 439/180 |
| 7,413,456 | B1 | 8/2008 | DiFusco | |
| 8,251,724 | B2 * | 8/2012 | Lee | F21V 19/0085 439/232 |
| 9,362,672 | B1 * | 6/2016 | Sun | H01R 13/639 |
| 9,768,571 | B1 * | 9/2017 | Peng | H01R 33/22 |
| 2012/0326623 | A1 | 12/2012 | Fatt | |

* cited by examiner

*Primary Examiner* — Jean F Duverne
(74) *Attorney, Agent, or Firm* — Paul Y. Feng; One LLP

(57) ABSTRACT

An Edison lamp holder adapter for adapting an electrical quick connect for connection to the lamp holder. The adapter includes an external housing and a ball shaped internal housing translating within the external housing. The external housing has lateral conductors formed with a resilient upper detent and a resilient lower detent, wherein the ball shaped internal housing selectively snaps into one of the detents. When the ball shaped internal housing resides within the upper detent, the electrical conductors of the adapter contact the internal conductors of the lamp holder to complete the circuit.

16 Claims, 6 Drawing Sheets

SECTION A-A

SECTION B-B

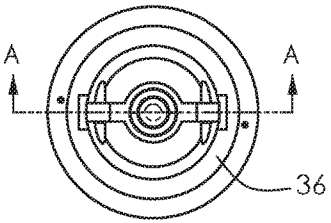
FIG.12
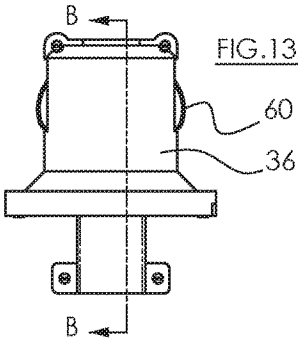
FIG.13
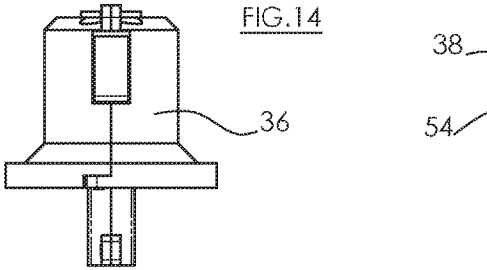
FIG.14
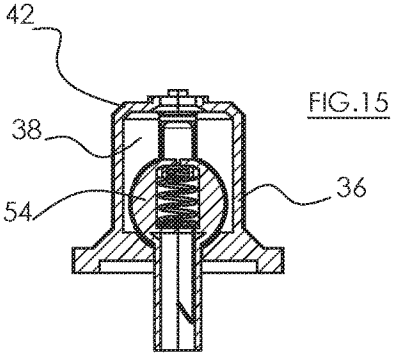
FIG.15
SECTION A-A
FIG.16
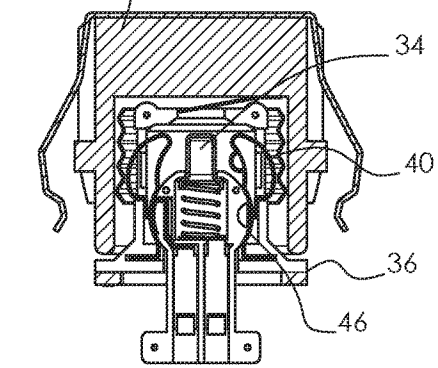
FIG.17
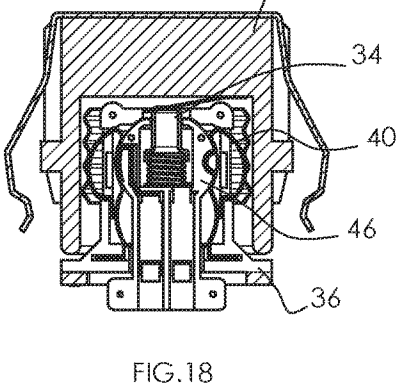
FIG.18
SECTION B-B

ELECTRICAL ADAPTER WITH INTEGRAL CONNECTOR

CROSS-REFERENCE TO RELATED APPLICATIONS

This application claims priority from provisional application No. 62/550,551, filed Aug. 25, 2017, and from provisional application No. 62/659,625, filed Apr. 18, 2018, the contents of all of which are hereby incorporated by reference.

FIELD OF THE INVENTION

The present invention relates to residential and commercial lighting fixtures. In particular, the present invention relates to mounting hardware for ceiling light fixtures or similar luminaires.

BACKGROUND OF THE INVENTION

Recessed lighting fixtures are commonplace in residential homes and commercial buildings. A recessed lighting fixture typically has a metal housing or can, an electrical junction box, and a conical-shaped recessed trim piece to direct and reflect the lighting emitted by a bulb that is in a bulb holder or socket. The recessed lighting "can" is installed above the ceiling in a building or house so that the opening in the can and trim are flush with the ceiling. The light is thus recessed into the ceiling.

The current trend is to use energy efficient LEDs in all light fixtures including recessed light fixtures. The trend includes adapting an LED trim assembly for use in a preexisting light fixture that was originally designed to accept an incandescent bulb or compact fluorescent light which have Edison base sockets.

SUMMARY OF THE INVENTION

The present invention in various exemplary embodiments is directed to an adapter for use with an Edison lamp holder having electrical conductors and threads therein. The adapter allows a quick connect or like connector to plug into an Edison screw type socket or lamp holder. A preferred embodiment adapter comprises an exterior housing having an internal space leading to an open bottom, wherein the bottom further includes a radial flange; an internal housing having a ball shaped top and a connector bottom having electrical contacts therein, and having a center electrical conductor extending out from the ball shaped top of the internal housing; a biasing means disposed inside the internal housing for biasing the center electrical conductor out of the internal housing; lateral electrical conductors disposed within the internal space of the exterior housing, wherein each of the lateral conductors includes a resilient upper groove detent and a resilient lower groove detent; wherein the internal housing translates within the exterior housing such that the ball shape top selectively slides into either the upper groove detent or the lower groove detent. When the ball shaped top of the internal housing engages the upper groove detent, the lateral electrical conductors and the center electrical conductor are in contact with the electrical conductors inside the lamp holder. The connector bottom of the internal housing is configured to receive a quick connect or like electrical connector commonly used with, e.g., an LED trim assembly, LED light fixture, etc.

BRIEF DESCRIPTION OF THE DRAWINGS

FIG. 12 shows a top plan view of a third exemplary embodiment Edison socket adapter.

FIG. 13 is a side elevational view of the adapter from FIG. 12.

FIG. 14 is another side elevational view of the adapter from FIG. 12.

FIG. 15 is a cross-sectional view taken along line B-B of FIG. 13.

FIG. 16 is a cross-sectional view taken along line A-A of FIG. 12.

FIG. 17 shows the adapter inserted into a lamp holder in unlocked mode.

FIG. 18 shows the adapter inserted into a lamp holder in the engaged/locked mode.

DETAILED DESCRIPTION OF THE PREFERRED EMBODIMENTS

The present invention is directed to an Edison adapter configured to install into an Edison base lamp holder or socket. The Edison base or socket is commonly found in residential and commercial lighting fixtures designed to receive, e.g., incandescent, halogen, CFL, and LED light bulbs. The most common socket is the Edison E26 base that receives standard 25-, 40-, 60-, 75- and 100-watt incandescent bulbs at 120 Volts AC. There are other Edison socket diameters known in the art, and the preferred embodiments are equally applicable to those sizes. Common LED light fixtures, LED trim assemblies, and the like have a power connection that terminates in a quick connect or like connector that is incompatible with an Edison screw lamp holder. The present invention adapter enables such LED light fixtures or LED trim assemblies to directly plug into the Edison lamp holder.

Figure 1:
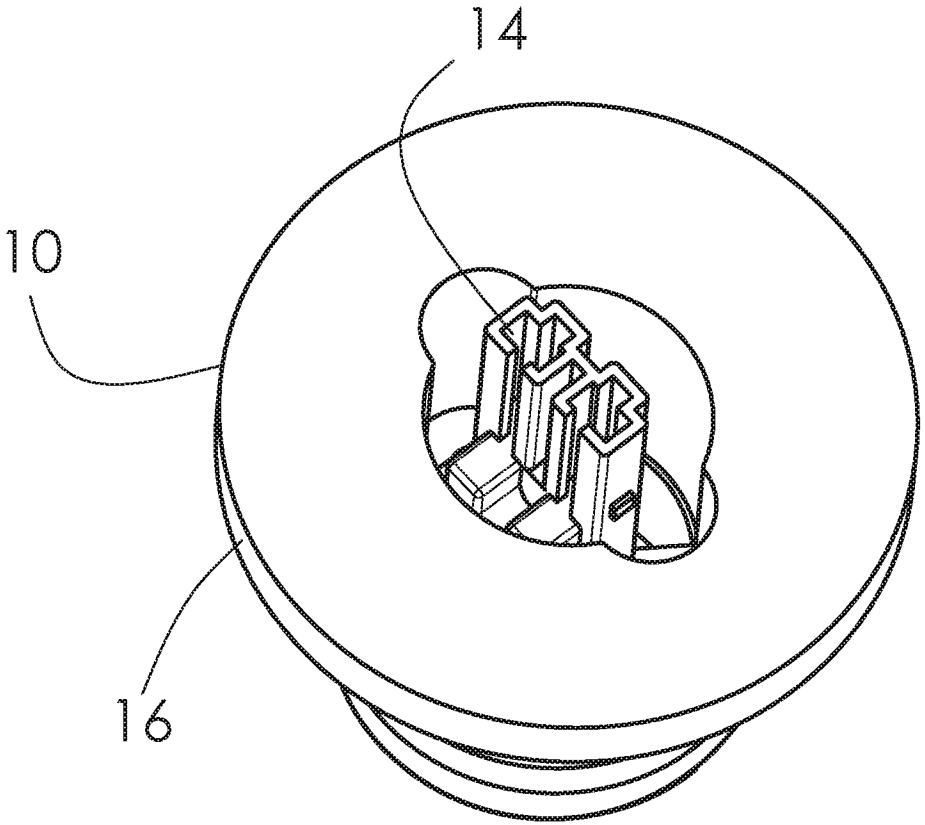
FIG. 1 is a perspective view of the underside of a first exemplary embodiment Edison socket adapter with a quick connect integrated into the adapter.
Figure 2:
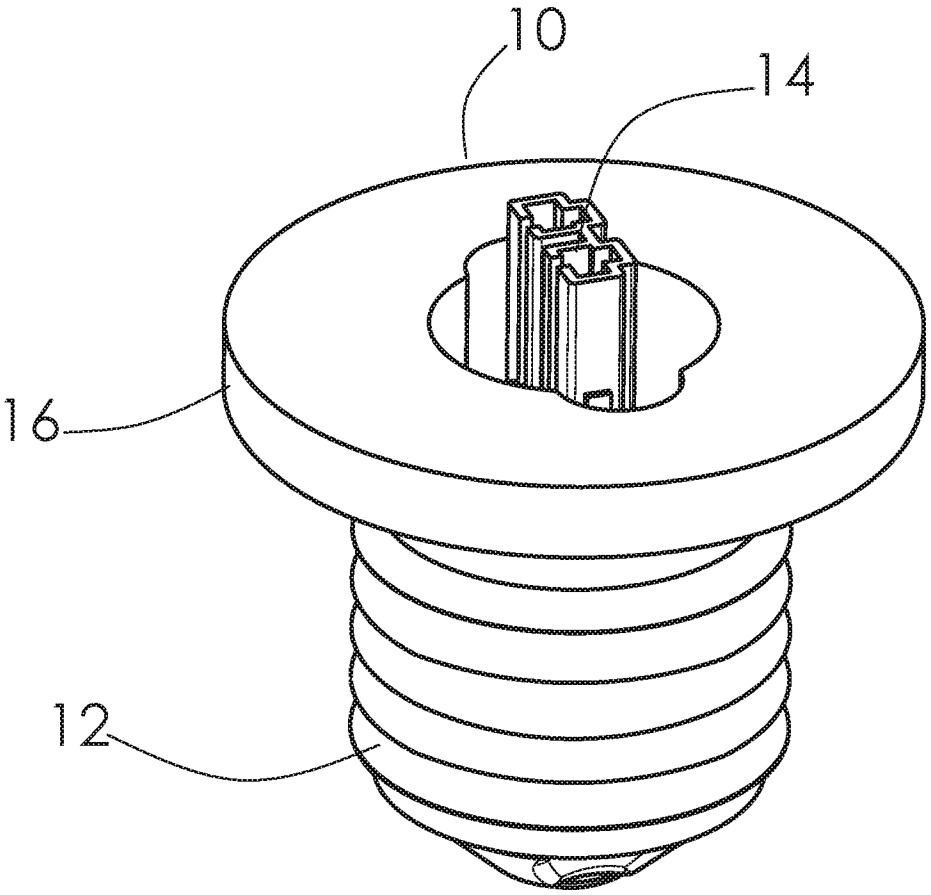
FIG. 2 is a side view of the Edison socket adapter of FIG. 1.

In a first exemplary embodiment shown in FIGS. 1-2, the adapter 10 includes a metal Edison screw plug 12 having a female quick connect 14 extending from a flange 16 at the underside of plug 12. The female quick connect 14 includes two channels with electrical contacts contained therein. The plastic flange 16 serves as an insulator to block the user's fingers from accidentally touching the Edison socket/lamp holder during installation. The Edison plug 12 has metallic external threads that screw into the corresponding Edison base lamp holder. A complementary male quick connect (not shown) connects electrical components from, e.g., an LED trim assembly, by plugging into the corresponding channels in the female quick connect 14. The male and female quick connects lock together via friction fit, a mechanical snap, or the like.

Figure 7:
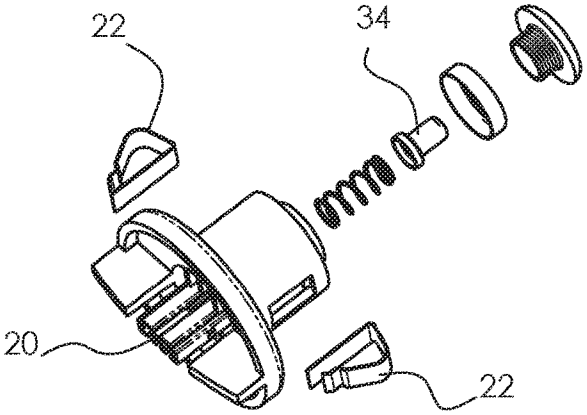
FIG. 7 is an exploded view of the adapter of FIG. 3.
Figure 6:
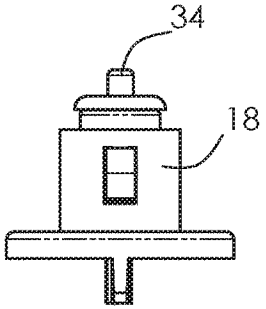
FIG. 6 is another side elevational view of the Edison socket adapter of FIG. 3.
Figure 3:
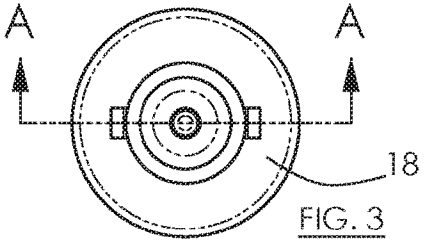
FIG. 3 is a top plan view of a second exemplary embodiment Edison socket adapter.
Figure 4:
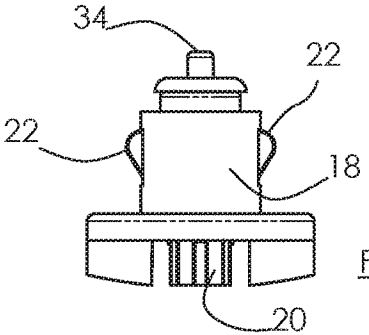
FIG. 4 is a side elevational view of the second embodiment Edison socket adapter of FIG. 3.
Figure 5:
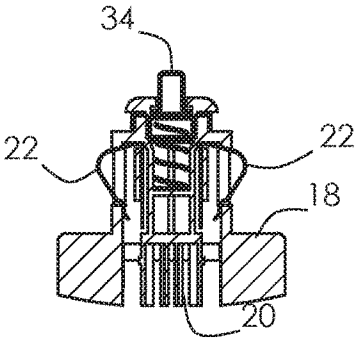
FIG. 5 is a cross-sectional view of the adapter taken along line A-A of 3.
Figure 10:
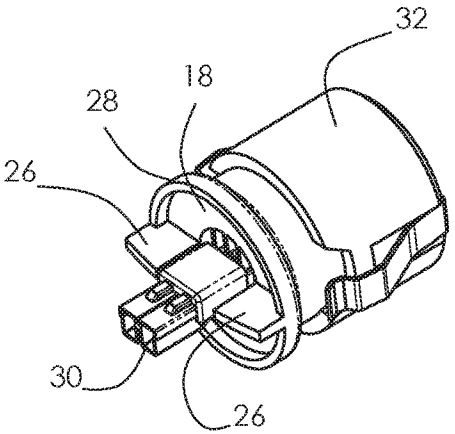
FIG. 10 is a perspective view of the adapter fitted into the lamp holder.
Figure 11:
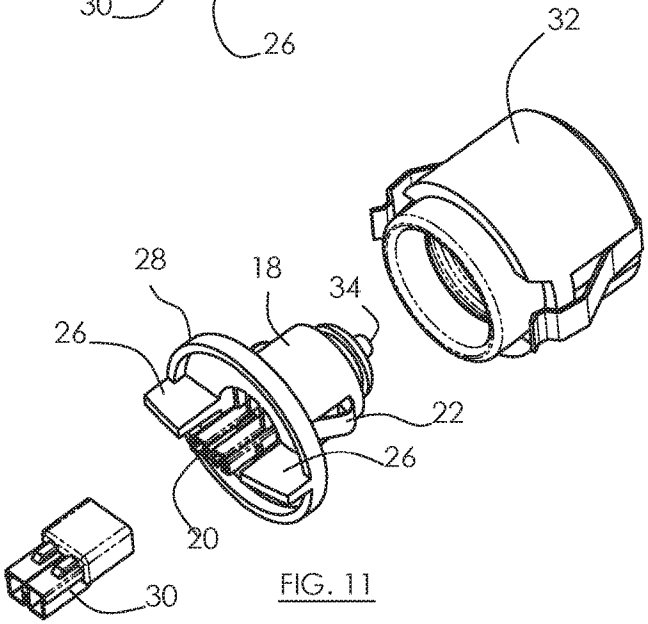
FIG. 11 is an exploded view of the adapter and lamp holder.
Figure 8:
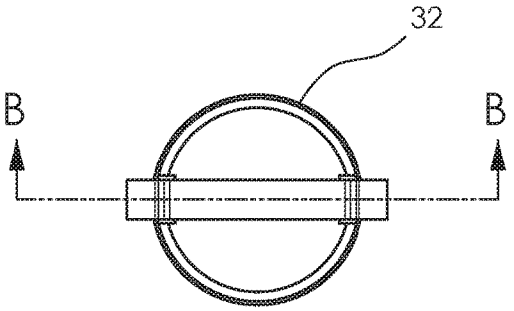
FIG. 8 shows a plan view of a generic Edison socket or like lamp holder.
Figure 9:
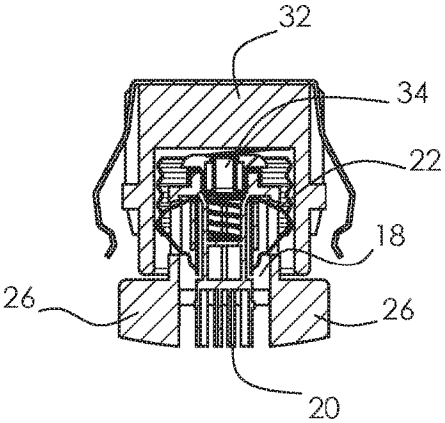
FIG. 9 is a cross-sectional view taken along line B-B of FIG. 8 showing the adapter fitting insider the lamp holder.

A second exemplary embodiment Edison adapter 18, shown in FIGS. 3-7, installs by a user pushing it into the standard Edison E26 or medium base lamp holder, shown in FIG. 8. Application to other sized lamp holders are contemplated. Other Edison base sizes are contemplated. In this embodiment, the adapter 18 is configured with a mating connector 20, preferably a male or female component of a plastic, snap-together quick connect, that is installed between the adapter 18 and, e.g., an LED driver of a light engine, LED trim assembly, or light fixture. The cross-sectional view of FIG. 5 shows the internal electrical connection between the mating connector 20 and the bowed electrical contacts 22 that engage the interior of the Edison base lamp holder 32 as seen in FIGS. 9-11.

Still another embodiment has the present invention adapter hard-wired directly to the LED driver. That is, the quick connector components are omitted. Then the adapter is inserted into the Edison lamp holder and the LED driver or LED light fixture is now both physically and electrically connected to the lamp holder.

The present embodiment adapter 18 has at least one electrical contact portion for each leg of the AC circuit 22, as best seen in the exploded view of FIG. 7, and the cross-sectional view of FIG. 5. Each bowed contact portion 22 includes an electrical conducting metal that is also resilient while formed preferably into a D-shape or similar geometry. Each contact portion 22 resiliently deforms and expands inside the lamp holder; the contact port 22 compresses against a mating surface of the metallic interior of the lamp holder when it is installed. Aside from the electrical conduction, this compression provides a mechanical means to hold the adapter 18 inside the lamp holder and it ensures that there is intimate contact to make a good electrical connection.

FIG. 7 also shows an electrode 34 that is spring biased at one end of the adapter 18. Once inserted into the lamp holder/base 32, the electrode 34 and the contact portions 22 engage the live contacts inside the Edison base 32 to complete the AC circuit.

As seen in FIGS. 9, 10, 11, the adapter 18, when installed into a fixed lamp holder or base 32, only requires the user to use one hand for installation. When installing the present embodiment while standing on a ladder, the user with one hand can snap the adapter 18 into a standard Edison socket, base, or lamp holder 32 with a push, with the resilient contacts 22 snapping over the socket threads, or optionally advanced by a turning motion. Once the adapter 18 is snapped into the Edison lamp holder 32, the preferably female end of a quick connect 20 is exposed. Still with the same hand, the user can take the complementary male quick connect 30 (FIG. 11), which has a wire leading to an LED light engine, LED driver, LED trim assembly, or the like (not shown), and insert it into the female quick connect 20 for a snap fit. The light fixture, light engine, LED trim assembly, etc. generally has its own mounting structure to install to the ceiling.

The present invention push-in adapter 18 does not require the user to thread, i.e., rotate the adapter into the lamp holder 32. This reduces time for installation and further reduces the need for a mating connector between the lamp holder and LED driver, LED trim assembly, light fixture, etc. Also, a straight push-in connection of the present adapter 18 without a rotating motion avoids the wiring leading to the LED trim assembly from getting twisted during installation. Thus, the present invention push-in adapter can be installed with one hand, leaving the other hand free to support the LED trim assembly, hold on to the ladder, to grasp a tool or flashlight, etc. The adapter embodiments according to the present invention integrated quick connect provide more versatility to the end user to choose a dedicated LED housing or retrofit to a housing with a preexisting, standard Edison screw lamp holder.

The exemplary embodiments apply a push-in motion. These exemplary embodiments are preferably made in one piece for everything except for the bottom contact for the "live" contact portion of the circuit. As noted, such embodiments require only one step to install and complete the circuit.

The Edison base adapter 18 is shown in FIGS. 10-11 inserted into a lamp holder 32. The adapter 18 includes an optional vertical wall 26 that extends parallel with the vertical center line of the adapter 24 and toward the user from a flange 28. The wall 26 and flange 28 are preferably made from an electrical insulator such as plastic or ceramic. The two walls or fins 26 are spread 180 degrees apart on either side of the adapter centerline. The walls or fins 26 and flange 28 reduce the chance of the end user accidentally contacting the "hot" screw shell during installation since the user's hand will remain isolated away from the lamp holder when grasping the vertical wall.

FIGS. 10, 11 show the quick connect 20 formed with the adapter 24 and its connection to the complementary quick-connect 30, which would normally be hard wired to an LED driver, LED trim assembly, LED light fixture, etc. (not shown). FIG. 9 is a cross-sectional view of the adapter 18 inserted into the Edison base/lamp holder 32. The bowed electrical contacts 22 have been deflected and exert an outward radial bias against the electrically live interior of the Edison base 32. The electrode 34 is pushed against its spring bias and engages the standard electrical contact inside the Edison socket 32.

Figure 19:
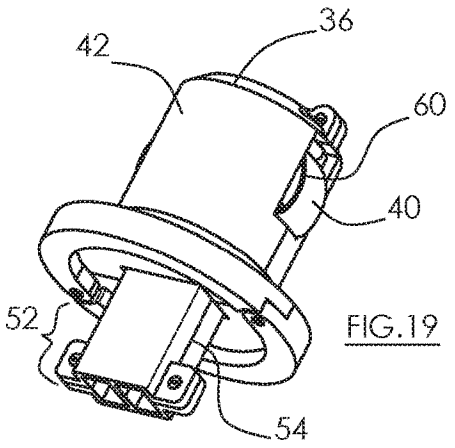
FIG. 19 is a perspective view of the third exemplary embodiment Edison socket adapter of FIG. 12.
Figure 20:
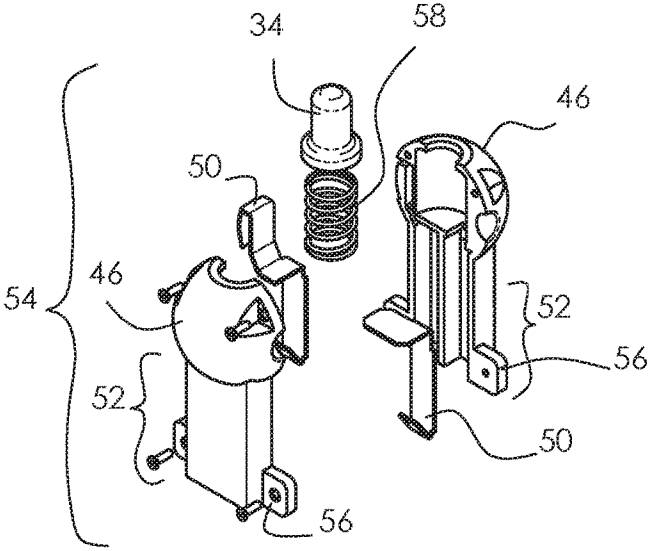
FIG. 20 is an exploded view of the adapter from FIG. 12.

In a third exemplary embodiment, shown in FIGS. 12-21, the Edison adapter 36 preferably features a ball and socket arrangement. As seen in the exploded view of FIG. 21, the adapter 36 is preferably made from an external housing 42 and an internal housing 54 that is disposed inside the external housing 42. As seen in FIG. 20, the internal housing 54 preferably has a ball shaped top 46 (i.e., "ball portion") transitioning to a connector bottom 52. The connector bottom 52 preferably is in the form of an electrical receptacle or plug, with internal electrical contacts 50. Optional tabs 56 extend radially out from the connector bottom 52 for finger leverage that helps with manual attachment to a quick connect. In an alternative embodiment, the ball shaped top 46 of the internal housing 54 need not encompass the entire housing top; there may be simple radial ridges or curved protrusions on the surface of the housing to achieve the ball and socket function described in detail below. Plastic is the preferred material for these molded components.

Within the external housing 42 at its center is an internal space or cavity 38, i.e., the "socket portion." Held inside the cavity 38 are two lateral conductors 40 fashioned to have two resilient grooves or detents 44, specifically, an upper groove detent and a lower groove detent. Each groove detent 44 deflects under force and selectively receives the ball shaped top 46 that slides into either one of two. See FIGS. 17, 18. Detent position one, or the lower groove detent position (FIG. 17), allows the resilient conductors 40 to have a greater freedom for deflection since there is more space inside the external housing 42. This makes the adapter 36 easy to install into an E26 lamp holder 48. Detent position two, or the upper groove detent position (FIG. 18), locks the ball shaped top 46 tightly in place inside the external housing 42, because it is located in a more restrictive space inside the external housing 42. Thus, the user can push or tug on the exposed connector bottom 52 of the internal housing 54 to slide the ball shaped top 46 from one detent groove position to the other.

Figure 21:
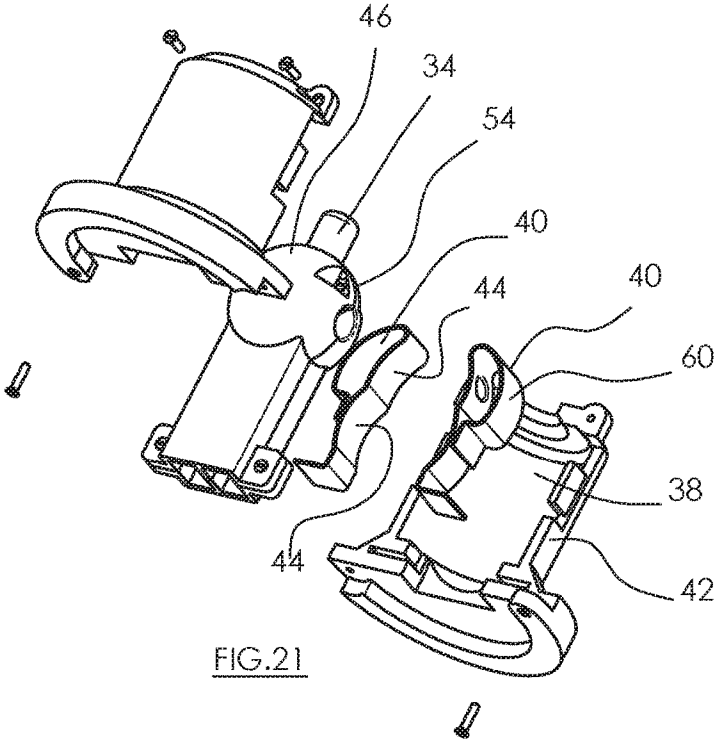
FIG. 21 is another exploded view of the adapter from FIG. 12.

Preferably, each lateral conductor 40 further includes a resilient bowed section 60 that has a radially-outward bias. The bowed section 60 extends out of the external housing 42, as seen in FIG. 19. As seen in FIGS. 17-18, the outward biased bowed section 60 presses against the internal threads of the Edison lamp holder 48 to hold the adapter 36 in position inside the lamp holder 48. On the other hand, the two resilient lateral conductors 40 at the detents 44 are biased radially inward to squeeze the ball shaped top 46. To achieve the different deflection and biasing action, the preferred embodiment lateral conductor 40 includes a flattened hoop shape with the bowed section 60 located generally opposite the detents 44 as seen in FIG. 21. The closed hoop shape is preferable as it exhibits hoop strength that provides the simultaneous inward and outward bias on opposite sides of the hoop in the present application.

The two lateral conductors 40 function as biasing springs as described above, but also function as electrical conductors for AC power, so they are preferably made from a metallic conductor. The two lateral conductors 40 are preferably disposed diametrically opposed to each other inside the cavity 38 of the external housing 42. There are preferably two lateral conductors 40 along with the center conductor 34 in order to connect with typical three wire AC circuits. More or fewer lateral connectors are contemplated to connect with whatever prevailing electrical supply circuits are being used.

FIG. 20 is an exploded view of the preferred embodiment internal housing 54. Inside is a center conductor or electrode 34, and electrical contacts 50 that engage a quick connect that fits into the connector bottom 52. The center conductor 34 is biased by a biasing means such as a compression spring 58 that urges the center conductor 34 upward and out of the internal housing 54 for contact against the lamp holder 48. The connector bottom 52 of the internal housing 54 may be configured as either a male or female part of a standard quick connect. The electrical contacts 50 and center conductor 34, along with the lateral conductors 40 close the circuit with the electrical contacts inside the Edison socket or lamp holder 48.

FIGS. 12-14 are a top plan view, and two rotated side elevational views of the preferred embodiment Edison adapter 36. FIGS. 16 and 15 are cross-sectional views taken along lines A-A of FIG. 12 and line B-B of FIG. 13, respectively.

FIGS. 17, 18 illustrate the ball and socket action of the preferred embodiment adapter 36 inside an Edison base/lamp holder 48. Once the adapter 36 is initially pushed into the Edison lamp holder 48, FIG. 17, the first motion, then the ball shaped top 46 is pushed fully into the cavity or socket 38 by the user under finger pressure, FIG. 18, the second motion. In reality, the two motions are actually one continuous action. This illustrates the single push-in action for connection of the adapter 36 to the Edison lamp holder 48. Separating the two just requires a downward tug on the adapter 36 to detach it from the Edison lamp holder 48.

FIGS. 17 and 18 depict a second feature of the lateral conductors 40. In FIG. 17, the ball shaped top 46 is located in the lower detent position inside the cavity 38. The manual finger push of the user forces the lateral conductor 40 radially outward as the ball shaped top 46 slides into the tighter-spaced, upper detent position, shown in FIG. 18. This radially outward pressure created by the apposition of the ball shaped top 46 into the tight upper detent position further compresses the bowed section 60 of the lateral conductor 40 between the ball shaped top 46 and the neutral part of the internal threads of the E26 lamp holder 48. The action helps secure the adapter 36 into the lamp holder 48 and presses the center conductor 34 forward into the electrical contact inside the Edison base 48. This completes the AC circuit. Beneficially, when the ball shaped top 46 is pushed into position in FIG. 18, it locks the adapter 36 in and completes the electrical circuit in one motion by the user.

Once the adapter 36 is locked inside the lamp holder 48, the user can insert a complementary quick connect or like electrical connector (not shown) into the connector bottom 52. The complementary quick connect would typically be wired to the LED driver or LED light fixture to complete the electrical wiring steps of the light fixture installation. The light fixture itself typically has its own mechanical support structure.

In the various applications, the present invention is preferably designed to be used with 120 VAC and LED lighting fixture trims. The electrical and mechanical design considerations preferably centered around high voltage operation and locking the adapter into a threaded socket. Furthermore, the preferred embodiments and their components disclosed herein are intended to be mixed-and-matched, and modified with each other.

While particular forms of the invention have been illustrated and described, it will be apparent that various modifications can be made without departing from the spirit and scope of the invention. It is contemplated that components from one embodiment may be combined with components from another embodiment.

What is claimed is:

1. An adapter for use with an Edison lamp holder having electrical conductors and threads therein, comprising:

an exterior housing having an internal space leading to an open bottom, wherein the bottom further includes a radial flange;

an internal housing having a ball shaped top and a connector bottom having electrical contacts therein, and having a center electrical conductor extending out from the ball shaped top of the internal housing;

a biasing means disposed inside the internal housing for biasing the center electrical conductor out of the internal housing;

lateral electrical conductors disposed within the internal space of the exterior housing, wherein each of the lateral conductors includes a resilient upper groove detent and a resilient lower groove detent;

wherein the internal housing translates within the exterior housing such that the ball shape top selectively engages either the upper groove detent or the lower groove detent; and wherein when the ball shaped top engages the upper groove detent, the lateral electrical conductors and the center electrical conductor are in contact with the electrical conductors inside the lamp holder.

2. The adapter of claim 1, wherein the connector bottom of the internal housing includes a mechanical locking means.

3. The adapter of claim 1, wherein the connector bottom of the internal housing is adapted to receive a complementary quick connect.

4. The adapter of claim 1, wherein the lateral electrical conductor further includes a bowed section that protrudes out of the external housing to frictionally engage the threads of the lamp holder.

5. The adapter of claim 1 wherein the interior housing and the exterior housing include a plastic material.

6. The adapter of claim 1, wherein the biasing means includes a compression spring.

7. The adapter of claim 1, wherein the connector bottom includes internal receptacle channels and outward extending tabs.

8. The adapter of claim 1, wherein the adapter includes two lateral electrical conductors diametrically disposed opposite to each other.

9. The adapter of claim 1, wherein the center electrical conductor includes a peg shape.

10. An adapter for use with an Edison lamp holder having electrical conductors and threads therein, comprising:

an exterior housing having an internal space leading to an open bottom, wherein the bottom further includes a radial flange;

an internal housing having a ball shaped top transitioning to an elongated connector bottom with electrical contacts therein, and having a center electrical conductor extending out from the ball shaped top of the internal housing;

a biasing means disposed inside the internal housing for biasing the center electrical conductor out of the internal housing;

lateral electrical conductors disposed within the internal space of the exterior housing, wherein each of the lateral conductors includes a resilient upper groove detent and a resilient lower groove detent, and further includes a bowed section;

wherein the internal housing translates within the exterior housing such that the ball shape top selectively, mechanically lock within either the upper groove detent or the lower groove detent; and wherein when the ball shaped top engages the upper groove detent, the bowed sections of the lateral electrical conductors and the center electrical conductor are in contact with the electrical conductors inside the lamp holder.

11. The adapter of claim 10, wherein the center electrical conductor and the lateral electrical conductor include an electrically conductive metal.

12. The adapter of claim 10, wherein the connector bottom includes a means for locking to a quick connect.

13. The adapter of claim 10, wherein each lateral connector at the upper and lower groove detents exerts a radially inward bias against the ball shaped top of the internal housing.

14. The adapter of claim 10, wherein the internal housing and the external housing are fabricated from plastic.

15. An adapter for use with an Edison lamp holder having electrical conductors and threads therein, comprising:

an exterior housing having an internal space leading to an open bottom;

an internal housing having a ball shaped top and a connector bottom having electrical contacts therein, and having a center electrical conductor extending out of the internal housing;

a biasing means disposed inside the internal housing for biasing the center electrical conductor out of the internal housing;

at least two lateral electrical conductors disposed within the internal space of the exterior housing, wherein each of the lateral conductors includes a resilient upper groove detent, a resilient lower groove detent, and a bowed section;

wherein the internal housing translates within the exterior housing such that the ball shape top selectively engages either the upper groove detent or the lower groove detent; and wherein when the ball shaped top engages the upper groove detent, the lateral electrical conductors and the bowed section of the center electrical conductor are in contact with the electrical conductors inside the lamp holder.

16. The adapter of claim 15, wherein the lateral electrical conductor includes a flattened hoop shape containing the upper and lower groove detents and the bowed section.

* * * * *